US005360384A

United States Patent [19]

Toensing

[11] Patent Number: 5,360,384

[45] Date of Patent: Nov. 1, 1994

[54] GYMNASTIC SPOTTING BELT APPARATUS

[76] Inventor: Timothy L. Toensing, 574 Vicki La., Shoreview, Minn. 55126

[21] Appl. No.: 100,033

[22] Filed: Jul. 30, 1993

Related U.S. Application Data

[63] Continuation-in-part of Ser. No. 889,163, May 27, 1992, abandoned.

[51] Int. Cl.[5] ..... A63D 26/00

[52] U.S. Cl. ..... 482/43; 482/23

[58] Field of Search ..... 482/23, 43, 105, 123, 482/124, 125, 139

[56] References Cited

U.S. PATENT DOCUMENTS

| | | | |
|---|---|---|---|
| 1,618,273 | 2/1927 | Davidson . | |
| 3,432,163 | 3/1969 | Murphy . | |
| 3,937,461 | 2/1976 | Lew | 482/43 |
| 4,431,184 | 2/1984 | Lew et al. | 402/43 |

OTHER PUBLICATIONS

Nissen Gymnastic Equipment Catalog, Item Nos. 1304 adn 1306; 1974.

One page copy of brochure entitled "Gymnastics & Physical Education" date unknown.

Copies of 5 pages of gymnastic equipment entitled "Gym Aids" date unknown.

Pp. 131, 132, 134, 135 and 137 from a catalog of Para--gear Equipment Co., Inc.; date unknown.

*Primary Examiner*—Richard J. Apley

*Assistant Examiner*—Lynne A. Reichard

*Attorney, Agent, or Firm*—Palmatier, Sjoquist & Helget

[57] ABSTRACT

A gymnastic spotting belt apparatus for being buckled about the waist of a gymnast and for being clipped to a pair of spotting ropes. The belt apparatus includes at least four D-rings such that the belt apparatus may be used by either children or adults. Each of the D-rings includes a slot compartment having a height generally the same as the width of the belt to prevent the belt and D-rings from axially twisting relative to each other. The belt apparatus still further includes an elongate pad between the belt and the gymnast and running to each of the sides of the gymnast from the back of the gymnast for cushioning the belt relative to the gymnast and for supporting the back of the gymnast. The belt apparatus further includes a buckle which may be quickly tightened but which is resistant to unintended loosening or release.

13 Claims, 3 Drawing Sheets

GYMNASTIC SPOTTING BELT APPARATUS

This patent application is a continuation-in-part of patent application Ser. No. 889,163, filed May 27, 1992, now abandoned.

BACKGROUND OF THE INVENTION

The present invention relates to a safety belt apparatus and, more particularly, to a gymnastic belt apparatus for safely spotting gymnasts.

The degree of risk in learning and performing gymnastic skills is extremely high. To reduce this risk, a gymnast wears a safety belt, which is commonly known as a spotting belt. A pair of spotting ropes are typically connected to the spotting belt and held by a coach or spotter. Accordingly, the spotting belt and ropes permit the gymnast to perform aerial maneuvers on a trampoline or other apparatus or on the floor in a floor exercise routine with the coach or spotter maintaining some control over the aerial maneuvers to maximize the chances of a safe routine and landing for the gymnast.

SUMMARY OF THE INVENTION

An object of the present invention is to provide a gymnastics spotting belt which fits both adults and children.

Another object is to provide a gymnastic spotting belt with ring connections which remain oriented in one direction despite single axis rotation of the gymnast.

Another object is to provide a gymnastic spotting belt with a padded back support belt portion.

Another object is to provide a gymnastic spotting belt with a buckle that is readily adjustable, but is resistant to inadvertent quick release.

A feature of the present invention is the provision in a gymnastic spotting belt, of a first pair of spotting rope connection means on the belt for use by larger gymnasts, and of a second pair of spotting rope connection means on the belt for use by smaller gymnasts.

Another feature is the provision in a gymnastic spotting belt having rings for engaging the spotting ropes, of slot compartments in the rings for engaging the belt for minimizing axial movement of the ring around the belt.

Another feature is the provision in a gymnastic spotting belt, of an elongate pad disposed immediately inwardly of the belt and running from one side of the gymnast to the other side of the gymnast, around the back of the gymnast.

Another feature is the provision in a gymnastic spotting belt of a buckle having a frame with upper and lower frame portions and a post slidably engaging the upper and lower frame portions, a free end of the belt being looped about the post for buckling the belt.

An advantage of the present invention is that it is safe. The buckle is resistant to being inadvertently opened, yet is quickly adjustable. The extra pair of D-rings provide for proper orientation of the spotting ropes on the side of the gymnast, whether the gymnast is male or female, or is an adult or child. The slot compartment in the D-ring maintains the connection to the spotting rope on the safest portion of the D-ring: the curved portion. The back pad minimizes the chances of back injury.

Another advantage of the present invention is that it is simple to use.

Another advantage of the present invention is that it is inexpensive and simple to manufacture.

Another advantage of the present invention is that it is easy to put on.

Another advantage of the present invention is that it is quickly adjustable.

Another advantage of the present invention is that, when buckled, it remains buckled to the desired length. It has no tendency to readjust itself when in use.

Another advantage of the present invention is that the elongate pad stays put. In contrast, each of the pads of the prior art belt may slip from its respective hip which it is intended to engage.

Another advantage of the present invention is that it is comfortable to wear.

DETAILED DESCRIPTION OF THE PREFERRED EMBODIMENTS

Figure 2:
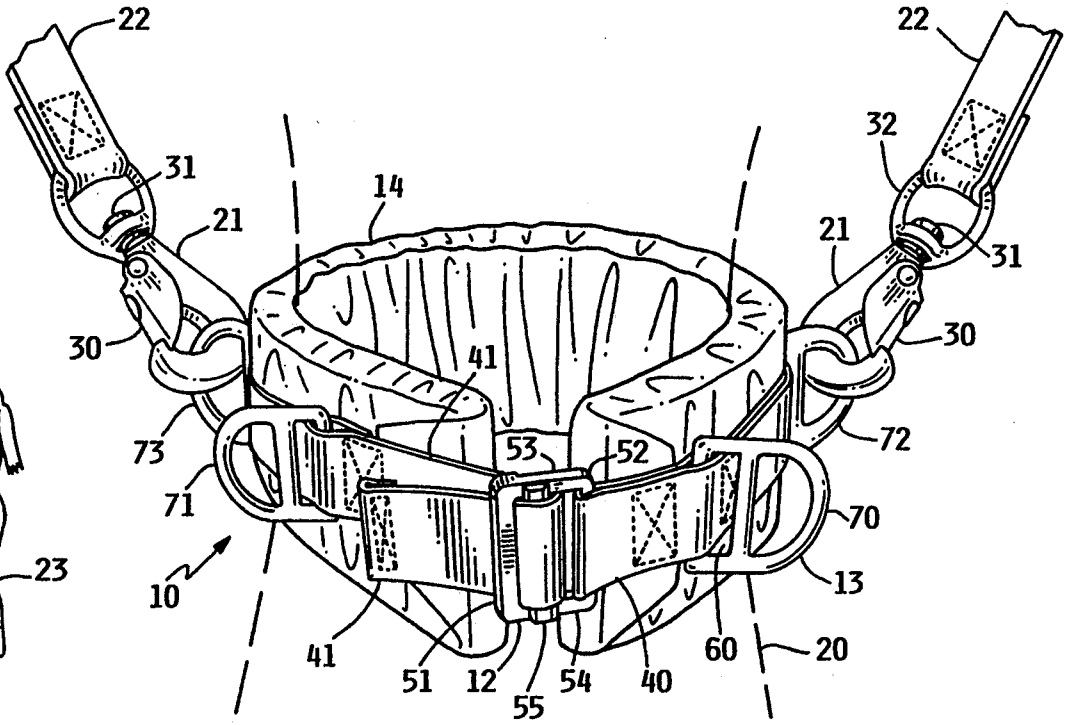
FIG. 2 is a detail perspective view of the belt apparatus of FIG. 1.
Figure 1:
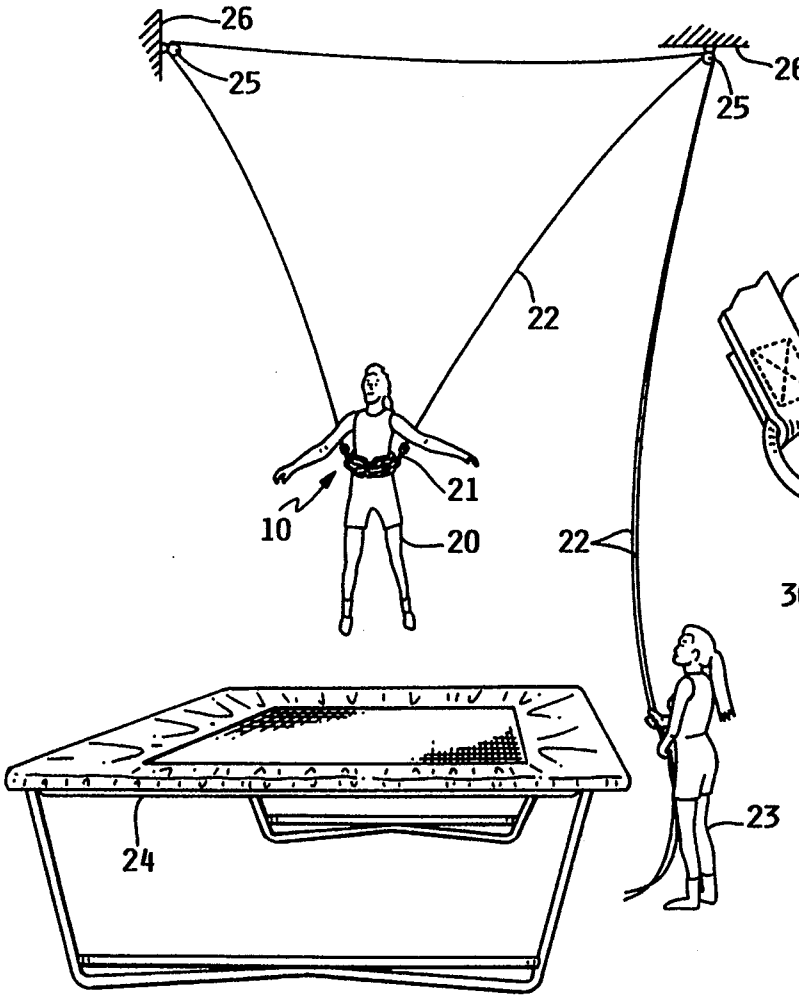
FIG. 1 is an environmental view of the present gymnastic spotting belt apparatus.
Figure 6:
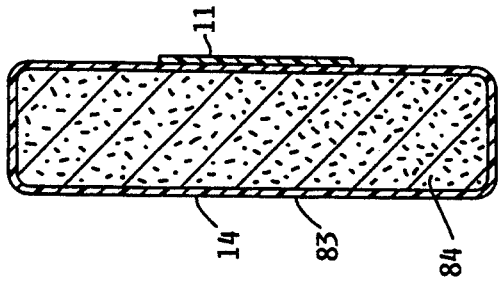
FIG. 6 is a section view at lines 6—6 of FIG. 3.
Figure 3:
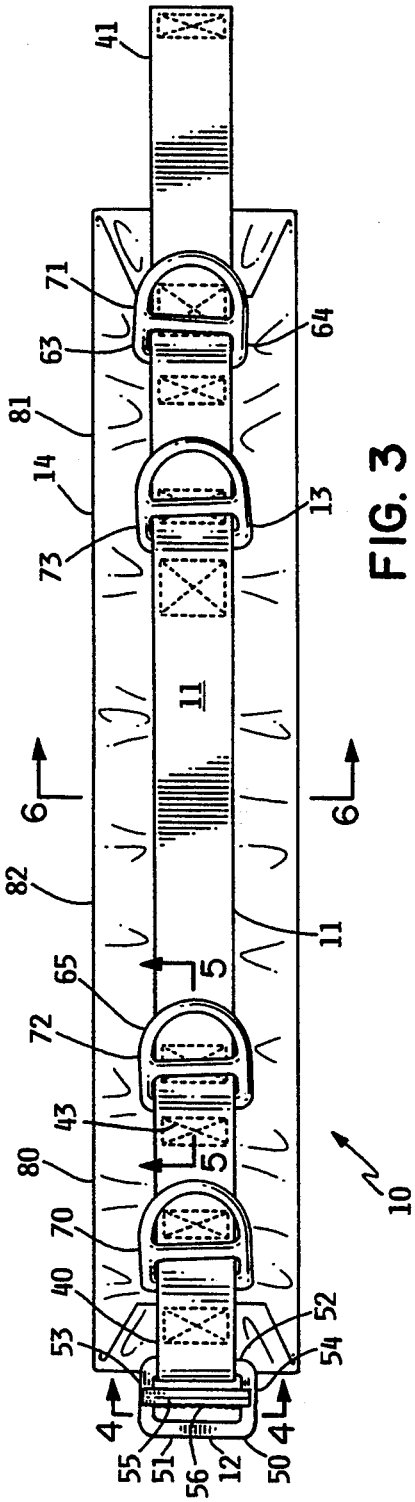
FIG. 3 is a detail elevation view of the belt apparatus of FIG. 1.

As shown in FIGS. 1, 2, and 3, the present gymnastics spotting or safety belt apparatus is indicated by the general reference numeral 10. It includes an integral one piece belt 11 having two layers, a buckle 12, spotting rope connectors or D-rings 13, and an elongate pad 14.

More specifically, as shown in FIGS. 1 and 2, the belt apparatus 10 is worn about the hips of a gymnast 20 and is engaged by gate swivel clips 21 on distal ends of spotting ropes 22. The proximal ends of the spotting ropes 22 are controlled by a coach or spotter 23 to aid the gymnast in learning and performing certain routines and landing safely on a trampoline 24. The spotting ropes 22 are engaged by pulleys 25 on supports 26.

Each of the gate clips 21 includes a gate 30 resiliently connected to the clip 21 to permit quick connection to the D-rings 13. Each of the gate clips 21 further includes a swivel mount 31 such that the clip 21 swivels for 360° about an annular portion 32 of the clip 21. The annular portions 32 are connected to the spotting ropes 22.

The belt 11 is integral and one piece from a buckle pivotally engaged end 40 to a free or strap end 41. The D-rings 13 are engaged on the belt 11 and prevented from sliding lengthwise thereon by belt sections 42 being stitched immediately inwardly of the belt 11. Such stitching is indicated by reference numeral 43. One belt section 42 is stitched between adjacent D-rings 13. With such an inwardly mounting, it should be noted that even if one of the belt sections 42 rips from the belt 11, the D-ring 13 remains engaged with the belt 11 to maintain a safe connection between the gymnast 20 and the spotting ropes 22. It should be noted that the belt sections 42, when affixed to the belt 11, form either a double or triple layer at the preference of an individual. One belt section 42 preferably extends from an area proximal to the buckle 12 toward the free strap end 41 and the other belt section 42 extends from an area proximal to the free strap end 41 toward the buckle 12. The pair of belt sections 42 do not overlap at the portion of the spotting belt apparatus 10 substantially opposite to the buckle 11 and proximal to the back of a gymnast 20. It should be noted that this portion of the spotting belt apparatus 10 may be either single or double layered at the preference of an individual.

Each belt section 42, following engagement to the belt 11, defines a pair of cavities 16. During use of the spotting belt apparatus 10, one of the cavities 16 for each belt section 42 is positioned proximal to the buckle 12 and the other cavity 16 for each of the belt sections 42 is positioned distal to the buckle 12. (FIG. 2) Each cavity 16 for each belt section 42 is adapted for receiving engagement of the slot compartment 60 of a D-ring 13. Each belt section 42 preferably extends through the slot compartment 60 of each D-ring 13 capturing a rear bar portion 61 within a cavity 16. It should be noted that each front bar portion 62 is positioned to the exterior of the belt sections 42 and the belt 11.

It should also be noted that the affixation of each slot compartment 60 to a belt section 42, capturing a rear bar portion 61 within a cavity 16, prevents axial rotation of a D-ring 13 with respect to the belt 11. The prevention of axial rotation of a D-ring 13, with respect to the belt 11 and belt sections 42, is critical to the operation and performance of the spotting belt apparatus 10. During operation, each D-ring 13 is required to be mounted in a static or fixed position on belt 11 with the exception of pivotal forward and backward movement as indicated by arrow 100 of FIG. 2. Each D-ring 13 therefore is prevented from axial rotation during aerial maneuvers performed by a gymnast 20 during practice of gymnastic routines. The fixed mounting of each D-ring 13 on the belt 11 uniquely adapts the spotting belt apparatus 10 for use in single axis rotational maneuvers. The spotting belt apparatus 10 should not be used in double axis gymnastic exercise due to the entanglement of the spotting ropes 22 with a gymnast 20 during twisting gymnastic routines. It is critical that the spotting belt apparatus 10 be used solely with single axis rotational exercise in order to avoid entanglement between a gymnast 20 and the spotting ropes 22. In the twisting spotting belts as are known in the art, the means for affixing the spotting ropes to the belt are permitted to rotate circumferentially around the waist of a gymnast 20. The spotting belt apparatus 10 strictly prohibits rotational movement of the D-rings 13, or the spotting belt apparatus 10, circumferentially about a gymnast's 20 waist during exercise. The risk of entanglement between a gymnast 20 and the spotting ropes 22 is thereby eliminated, significantly improving the safety to a user, while simultaneously minimizing risk of injury.

The existence of the slot compartments 60 of each D-ring 13 is critical to the operation of the spotting belt apparatus 10. The pivotal feature of the D-rings 13 as indicated by arrow 100 of FIG. 2 provides a degree of flexibility with respect to the position of a gymnast 20 with respect to the supports 26 during exercise. A gymnast 20 is thereby not restricted to being directly beneath and/or in a plane with the supports 26 during practice exercise routines. The utility of the spotting belt apparatus 10 is thereby significantly improved.

As shown in FIGS. 2, 3, 4, 7A and 7B, the buckle 12 includes a rectangular frame 50 having a first, free, side frame portion 51, a second, engaged, side frame portion 52, an upper frame portion 53, and a lower frame portion 54. Side frame portion 52 is pivotally connected to the belt end 40. A slidable H-shaped post 55 is engaged by and between the upper and lower frame portions 53, 54 and is slidable thereupon from one of the side frame portions 51, 52 to the other of the side frame portions 51, 52. The H-shaped post 55 includes a toughened face 56 for frictionally engaging and minimizing slippage of the free belt end 41. To secure the belt 11 about the gymnast 20, the free end 41 is inserted between the post 55 and the belt engaged side frame portion 52 from the rear face of the rectangular frame 50. (FIGS. 2, 7A, and 7B) The free end 41 is then looped around the post 55 to be inserted between the roughened face 56 of the post 55 and the unengaged side frame portion 51 from the front of the rectangular frame 50. With the free end 41 now being double-backed, the free end 41 is pulled to slide the post 55 toward the side frame portion 51 to pinch the belt free end 41 between the roughened face 56 of the post 55 and the first free side frame portion 51. Such a pulling action decreases the circumference of the belt 11 to tighten the belt apparatus 10 about the waist of the gymnast 20 and also provides a tight fit or coupling of the buckle 12 relative to the free end 41 of the belt 11. When so engaged, it should be noted that the greater the force attempting to draw the belt ends 40, 41 apart (arrows 102 of FIG. 7A), such as brought on by a gymnastic maneuver, the more the post 55 is pulled by looped end 41 toward the first free side frame portion 51, and the greater the pinching force between the roughened face 56 and the first free side frame portion 51. To loosen the belt 11, and disengage the buckle 12, the side frame portion 51 is drawn outwardly as seen in arrow 103 of FIG. 7B to pivot the frame 50 relative to the belt end 40 to relieve such a pinching force. Simultaneously with the pivoting of the side frame portion 51, the H-shaped post 55 slides toward the buckle 12 pivotally engaging end 40 as indicated by arrow 104 of FIG. 7B to release the free strap end 41.

The buckle 12 is affixed to the spotting belt apparatus 10 by looping the buckle pivotally engaged end 40 about the second engaged side frame portion 51 and stitching the buckle pivotally engaged end 40 to the belt 11. The buckle 12 is then permanently affixed to the spotting belt apparatus 10 permitting the free slidable movement of the H-shaped post 55 with respect to the upper and lower frame portions 53, 54.

The slidable engagement of the H-shaped post 55 to the upper and lower frame portions 53, 54, respectively, critically distinguishes the spotting belt apparatus 10 over the prior art. The H-shaped post solves the problems of swift and convenient release of the buckle 12 by use of one hand of a gymnast 20. In the past, spotting belts have required the complicated and slow manipulation of a buckle by the use of two hands of an individual. In addition, the release of the buckle only occurred upon complete separation of the belt from the buckle. The necessity for complicated manipulation of a buckle for release, and/or complete separation of a belt from a buckle, significantly increased the time required for removal of a spotting belt from the waist of a gymnast for use by another gymnast. In addition, the spotting belt devices as known, required repositioning of the affixation rings to conform to the size of a gymnast, further delaying the use of a spotting belt. Minimization of time loss and simplification of the engagement of a spotting belt for use by a number of different sized gymnasts is of critical importance. Frequently, a number of different sized gymnasts are waiting to practice gymnastic routines requiring the use of a spotting belt.

Delays during the adjustment of a spotting belt and/or delays resulting from complicated and time consuming disengagement of a buckle significantly reduces the available practice time for gymnasts.

The slidable engagement between the H-shaped post 55 and the upper and lower frame portions 53, 54 is critical for operation of the spotting belt apparatus 10 in order to significantly reduce the time required for engagement of the spotting belt 11 to a gymnast, while simultaneously simplifying the use of the safety device during practice of gymnastic routines. During engagement of the buckle 12, the free strap end 41 of the belt 11 is drawn in the direction of arrow 102 of FIG. 7A. The tension on the free strap end 41 frictionally draws the H-shaped post 55 towards the second engagement side frame portion 52 securing the spotting belt apparatus 10 around the waist of a gymnast 20. It should be noted that as the forces applied to the buckle 12 in the direction arrow 102 increase, the friction engagement between the H-shaped post 55, free strap end 41, and second engagement side frame 52 increase tightening the engagement between the buckle 12 and the belt 11. Therefore, during use of the spotting belt apparatus 10, the risk of separation of the belt 11 from the buckle 12 is minimized, if not eliminated.

Figure 7A:
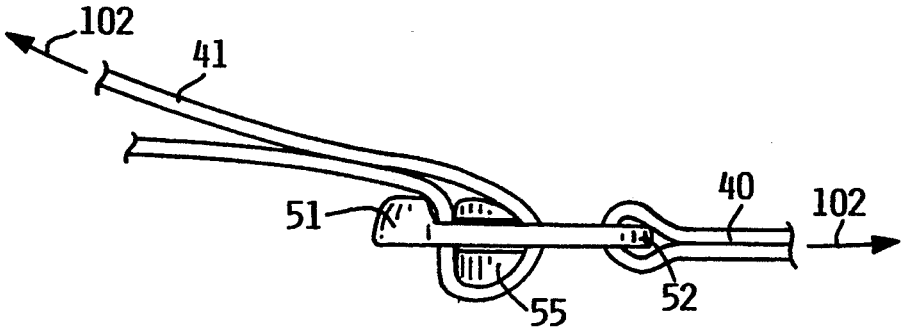
FIG. 7A is a detail view of the buckle engaged to the belt.
Figure 7B:
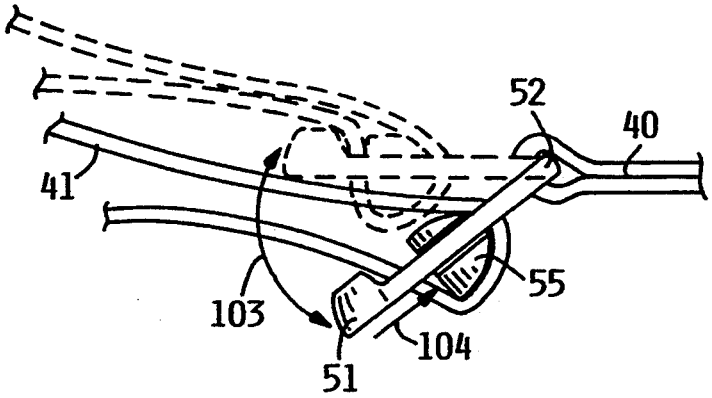
FIG. 7B is a detail view of the buckle being released from the belt.

The buckle 12 is easily released from tight engagement by pivotal manipulation in the direction of arrow 103 of FIG. 7B. The pivotal rotation of the first free side frame portion 51 in the direction of arrow 103 causes the H-shaped post 55 to slide toward the second engagement side frame portion 52 as indicated by arrow 104 of FIG. 7B. The free strap end 41 is thereby immediately and conveniently released, permitting expansion of the size of the spotting belt apparatus 10. It should be noted that complete separation of the free strap end 41 from the buckle 12 is not required during use of the spotting belt apparatus 10. Expansion of the circumference of the spotting belt apparatus 10 permits a gymnast to slide the invention downward over the individual's hips permitting the gymnast to step out from the interior of the invention. Another gymnast may then step into the interior of the spotting belt apparatus 10 for elevation over the individual's hips for retightening by drawing the free strap end 41, which has remained engaged to the buckle 12. The use of the H-shaped post 55 is critical for reduction of time required for expanding the size of the belt 11 from the waist of a gymnast following the completion of a practice gymnastic routine. The ability of the buckle 12 to be efficiently and quickly released significantly improves the utility of the spotting belt apparatus 10. The ability of the free strap end 41 to remain engaged to buckle 12 permits the efficient and fast interchange of the spotting belt apparatus 10 between consecutive gymnasts who may be of very different sizes. The minimization of loss of practice time for gymnast 20 is thereby accomplished. A critical solution to the problem of lost time is solved, permitting a waiting line of gymnasts to quickly and easily share a spotting belt apparatus 10 during the practice of gymnastic routines.

Figure 5:
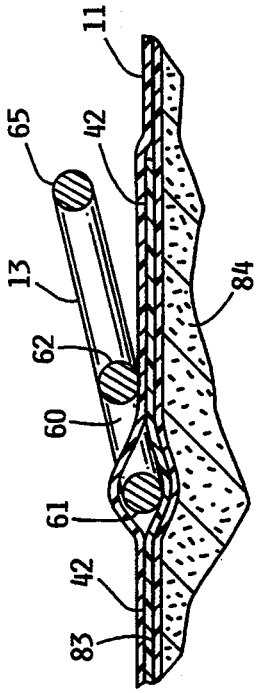
FIG. 5 is a section view at lines 5—5 of FIG. 3.
Figure 4:
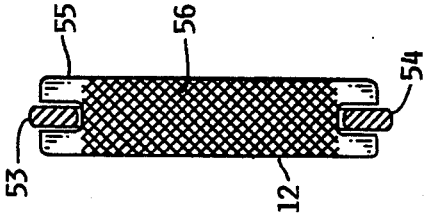
FIG. 4 is a section view at lines 4—4 of FIG. 3.

As shown in FIGS. 2, 3, and 5, each of the D-rings 13 includes a slot compartment 60 to minimize axial twisting or movement of the D-rings 13 relative to the belt 11. The slot compartment 60 is formed by a rear bar portion 61, a front bar portion 62, and upper and lower bar portions 63, 64. The slot compartment 60 includes a height (distance between upper and lower bar portions 63, 64) approximately equal to the width of the belt and a relatively narrow thickness (distance between rear and front bar portions 61, 62) to minimize an axial rotation of the D-ring 13 and to maximize the chances that the curved bar portion 65 remains in its proper orientation for engaging the gate clip 21. It should be noted the rear bar portion 61 is the portion of each of the D-rings 13 that is engaged between the belt 11 and its belt sections 42; this connection provides for a pivoting action of the D-rings 13 relative to the belt 11 on an axis perpendicular to the belt 11 while the slot compartment 60 prevents axial rotation of the D-rings 13. (Arrow 100 of FIG. 2)

The existence of a slot compartment 60 as a portion of a D-ring 13 is critical to the proper operation of the spotting belt apparatus 10. The slot compartments 60 prevent axial twisting and/or circular rotation of the D-rings 13 eliminating the possibility that the curved bar portion 65 may become positioned within a cavity 16 and the rear bar portion 62 may become engaged to a gate clip 21 and spotting rope 22. In the past, the rotation of a D-ring occurred during use of a spotting belt. Rotation of a D-ring is highly undesirable and potentially dangerous to a gymnast 20. Repositioning of a D-ring in the past frequently occurred during exposure to high impact stress forces encountered during single axis rotational routines. The D-rings 13 including the slot compartments 60 prevent axial rotation, thereby eliminating rotation of the curved bar portion 65 out of a desired position with respect to the belt 11. The fixed positioning of the curved bar portion 65 with respect to the belt 11 and belt sections 42 is of critical importance during operation of the spotting belt apparatus 10. Free, uninhibited, sliding movement of a gate clip 21 around the curved bar portion 65 is thereby required which significantly enhances the safety of a gymnast 20 by minimizing the risk of entanglement to the spotting ropes 22 during single axis rotational gymnastic routines.

Two pairs of D-rings 13 are provided on the belt 11 such that the belt apparatus 10 may fit either an adult or child gymnast. A first pair 70, 71 of D-rings 13 is intended for the larger gymnast. The D-rings of the first pair are disposed transversely of each other and are disposed on the sides or hips of the larger gymnast. Alternately, a second pair 72, 73 of D-rings 13 is intended for the smaller gymnast. The D-rings of the second pair are disposed on the sides or hips of the smaller gymnast.

In addition, the first pair of D-rings 70, 71 are positioned proximal to the buckle 12 during the use of a the spotting belt apparatus 10 and the second pair of D-rings 72, 73 are positioned distal to the buckle 12. It should also be noted that sufficient flexibility with respect to size of the spotting belt apparatus 10 is provided such that the belt 11 may be tightened around the waist to fit large, medium, or smaller sized gymnasts. The alternate use of any combination of the first or second pair of D-rings 70, 71, 72 and/or 73 may occur for support of a gymnast 20 during single axis rotational gymnastic routines. Particularly, one of the first pair of D-rings 70, 71 may be used in conjunction with one of the second pair of D-rings 72, 73 for positioning on opposite sides of the waist of the gymnast 20. A gymnast 20 is not required or limited to the use of either the first pair 70, 71 or the second pair 72, 73 of D-rings, but may interchange the use of any combination of D-rings to fit the waist size of the particular gymnast 20. The first and second pair of D-rings 70, 71, 72, and 73, respectively, permit the use of the spotting belt apparatus 10 with any sized gymnast 20, which is a critical feature required for minimization of time loss and expense during gymnastic training. It should be noted that during use of the spotting belt apparatus 10, the D-rings 13 are positioned traversely on opposite sides of the waist of a gymnast 20. The regular spacing relationship of the D-rings 13 along the belt 11 positions the spotting ropes 22 in a desired critical location exactly traversely of the hips of a gymnast 20 in order to minimize injuries, including rope burns which may be inflicted during entanglement with a spotting rope 22. The spaced positioning of the D-rings 13 minimizes the risk of entanglement of the spotting ropes 22 with the gymnast 20 during the practice of single axis rotational gymnastic routines.

The elongate pad 14 includes a pair of side portions 80, 81 to hug the hips or sides of the gymnast. A back portion 82 extends integrally between the side portions 80, 81 to run behind and support the small of the back of the gymnast. The pad 14 includes an outer vinyl layer 83 and a resilient, open cell foam interior 84. The pad 14 is affixed, such as by gluing, immediately inwardly of the belt 11 to be disposed between the belt 11 and the gymnast. It should be noted that the open cell foam interior 84 of the elongate pad 14 is not rigid or resilient but conforms to the individual shape of the waist of a gymnast providing support to the lower back. The open cell foam interior 84 provides a comfortable surface, cushioning the affixation of the spotting belt apparatus 10 around the waist of a gymnast 20. As such, the elongate pad 14 when engaged around the waist of a gymnast 20 may assume a circular or oval shape depending upon the waist shape of the user. The confirmation of the shape of the elongate pad to the individual shape of a gymnast 20 is a critical feature of the spotting belt apparatus 10. No padded surface is available in the prior art to completely surround and conform to the individual shape of a gymnast 20. The prior art, as known, did not conform to the shape of a gymnast 20. In addition, the prior art did not provide a comfortable cushion for engagement of a spotting belt apparatus 10 around the waist of a user.

In operation, the gymnast 20 wraps the belt apparatus 10 about her waist or hips, loops the free strap end 41 about post 55 and pulls the free end 41 until the pad 14 is relatively snug about her waist. The gymnast 20 then fastens the clips 21 to the pair of D-rings 13 that are located closer to her hips. A gymnastics routine may then be performed at minimal risk with the spotter 23 controlling the ropes 22.

During the routine, the buckle 12 remains safely secured. The buckle 12 includes no seat belt like buttons which may be inadvertently depressed. In fact, it is believed that during most, if not all, of the gymnastic routines presently practiced, the gymnast's body and maneuvers exert an outward pressure on the pad 14 and belt 11 to continuously draw the ends 40, 41 of the belt 11 away from each other to continuously pinch the free end 41 between the toughened surface 56 and the frame portion 51.

Further, during the routine, the pad 14 supports the lower back of the gymnast. No free side pads exist which may slip off of the hips of the gymnast. Because of the relatively narrow slot 60, the D-rings 13 remain in their normal operating position. The slots 60 prevent the D-rings 13 from rotating axially.

After the routine, the gymnast loosens the belt 11 by outwardly pivoting the buckle frame 50 such that the post 55 slides back toward the side frame portion 52. It should be noted that it may not be necessary to completely remove free end 41 from the buckle 12 for the next gymnast. Gymnasts may step into and out of the belt apparatus 10 if desired.

The spotting belt apparatus 10 is preferably designed for use in single axis rotational gymnastic routines. The spotting belt apparatus 10 is not designed for use in double axis or twisting rotational gymnast exercise. The spotting belt apparatus 10 is preferably fixedly positioned with respect to the hips of a gymnast, therefore, double axis rotational gymnastic maneuvers, in conjunction with use of spotting ropes 22, may cause the entanglement of the spotting ropes 22 to the gymnast 20 significantly reducing the safety to an individual. The critical features of the slots 60, cavities 16, alternate D-rings 13, elongate pad 14, H-shaped post 55, and buckle 12 in conjunction to the limited use of the spotting belt apparatus 10 during single axis rotational exercise, offers a significant advancement over the prior art. The spotting belt apparatus 10 overcomes the drawbacks of the prior art specifically with respect to the provision of a one-piece light weight and sturdy spotting belt as opposed to a separable two piece inflexible and cumbersome double axis spotting belt. The prior art double axis spotting belt requires the integrated coupling for circumferential rotation of two distinct, separable, clumsy, and heavy individual circular shaped units. Neither of the individual units of the double axis spotting belt affords comfortable confirmation to the individual shape of a gymnast, while simultaneously minimizing the weight or mass which a gymnast must carry during practice of single axis rotational maneuvers, as does the spotting belt apparatus 10.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A gymnastic spotting belt apparatus for engaging the waist of a larger or smaller sized gymnast and for engaging spotting ropes on both sides of the gymnast, the spotting belt comprising:

(a) An elongate pad having an outer layer and a resilient open cell foam interior for engaging the waist of either the larger or smaller gymnast;

(b) a belt affixed to said outer layer of said pad, said belt having a plurality of belt sections defining cavities, said belt further having two opposite ends;

(c) a pair of first D-rings, each of said first D-rings having an upper bar, a lower bar, a curved section extending between said upper bar and said lower bar, a rear bar extending between said upper bar and said lower bar opposite to said curved section, and an interior bar extending between said upper bar and said lower bar between said rear bar and said curved section, said interior bar defining an interior compartment between said rear bar and said interior bar, said rear bar being entrapped within one of said plurality of cavities, said curved sections of said first D-rings adapted for engagement to a spotting rope, said entrapment of said rear bar within one of said plurality of cavities preventing axial twisting of said first D-rings relative to said belt, said first D-rings adapted for positioning proximal to both sides of either the smaller or larger gymnast;

(d) a pair of second D-rings, each of said second D-rings having an upper bar, a lower bar, a curved section extending between said upper bar and said lower bar, a rear bar extending between said upper bar and said lower bar opposite to said curved section, and an interior bar extending between said upper bar and said lower bar between said rear bar and said curved section, said interior bar defining an interior compartment between said rear bar and said interior bar, said rear bar being entrapped within one of said plurality of cavities, said curved sections of said second D-rings adapted for engagement to said spotting rope, said entrapment of said rear bar within one of said plurality of cavities preventing axial twisting of said second D-rings relative to said belt, said position of said second D-rings on said belt being alternatives to said first D-rings, said second D-rings adapted for positioning proximal to both sides of either the smaller or larger gymnast; and (e) a releasable buckle affixed to said belt, said buckle having a frame having upper and lower frame portions, side frame portions, and a post slidably engaging the upper and lower frame portions between the side frame portions, said buckle adapted for securing said belt around the waist of either the larger or smaller gymnast by engagement of said opposite end of said belt to said buckle.

2. The gymnastic spotting belt apparatus according to claim 1, wherein said belt is comprised of two layers.

3. The gymnastic spotting belt apparatus according to claim 2, wherein said cavities are formed by stitching sections of said two layers of said belt together, where said cavities are defined as the unstitched portions of said belt between said stitched sections of said two layers.

4. The gymnastic spotting belt apparatus according to claim 3, wherein said belt sections and said cavities are spaced along said belt adapted for positioning proximal to both sides of either the larger or smaller gymnast.

5. The gymnastic spotting belt apparatus according to claim 4, wherein each of said rear bars of said first D-rings are positioned within one of said cavities perpendicular to said belt.

6. The gymnastic spotting belt apparatus according to claim 5, wherein each of said interior bars of said first D-rings is positioned exterior to one of said belt sections and one of said layers of said belt pass through said compartment.

7. The gymnastic spotting belt apparatus according to claim 6, wherein said entrapment of said rear bars of said first D-rings within one of said plurality of cavities prevents sliding of said first D-rings along said belt.

8. The gymnastic spotting belt apparatus according to claim 7, wherein said stitching of said belt sections define a fixed position of said first D-rings on said belt.

9. The gymnastic spotting belt apparatus according to claim 8, wherein each of said rear bars of said pair of second D-rings is positioned within one of said cavities perpendicular to said belt.

10. The gymnastic spotting belt apparatus according to claim 9, wherein each of said interior bars of said pair of second D-rings is positioned exterior to one of said belt sections and one of said layers of said belt pass through said compartment.

11. The gymnast spotting belt apparatus according to claim 10, wherein said entrapment of said rear bars of said pair of second D-rings within one of said plurality of cavities prevents sliding of said second D-rings along said belt.

12. The gymnastic spotting belt apparatus according to claim 11, wherein said stitching of said belt sections define a fixed position for said second D-rings on said belt alternatively to said first D-rings.

13. A gymnastic spotting belt apparatus for engaging the waist of a larger or smaller sized gymnast and for engaging spotting ropes on both sides of the gymnast, the spotting belt comprising:

(a) An elongate pad having an outer layer and a resilient open cell foam interior for engaging the waist of either the larger or smaller gymnast;

(b) a two layer belt affixed to said outer layer of said pad, said belt having a plurality of belt sections defining cavities formed therein by stitching portions of said two layers of said belt together, where said cavities are defined as the unstitched portions of said belt between said stitched sections of said two layers said belt further having two opposite ends, said belt sections and said cavities being spaced along said belt adapted for positioning proximal to both sides of either said larger or smaller gymnast;

(c) a pair of first D-rings, each of said first D-rings having an upper bar, a lower bar, a curved section extending between said upper bar and said lower bar, a rear bar extending between said upper bar and said lower bar opposite to said curved section, and an interior bar extending between said upper bar and said lower bar between said rear bar and said curved section, said interior bar defining an interior compartment between said rear bar and said interior bar, said rear bar being entrapped within one of said plurality of cavities, said rear bar positioned within said cavity perpendicular to said belt, said interior bar being exterior to one of said belt sections, one of said layers of said belt passing through said compartment, said curved sections of said first D-rings adapted for engagement a spotting rope, said entrapment of said rear bar within one of said plurality of cavities preventing axial twisting of said first D-rings relative to said belt, said entrapment of said rear bar within one of said plurality of cavities preventing sliding of said first D-rings along said belt, said stitching of said belt sections defining a fixed position of said first D-rings on said belt, said first D-rings adapted for positioning on said belt proximal to both sides of either the smaller or larger gymnast;

(d) a pair of second D-rings, each of said second D-rings having an upper bar, a lower bar, a curved section extending between said upper bar and said lower bar, a rear bar extending between said upper bar and said lower bar opposite to said curved section, and an interior bar extending between said upper bar and said lower bar between said rear bar and said curved section, said interior bar defining an interior compartment between said rear bar and said interior bar, said rear bar being entrapped within one of said plurality of cavities, said rear bar positioned within said cavity perpendicular to said belt, said interior bar being exterior to one of said belt sections, one of said layers of said belt passing through said compartment, said curved sections of said second D-rings adapted for engagement to said spotting rope, said entrapment of said rear bar within one of said plurality of cavities preventing axial twisting of said second D-rings relative to said belt, said entrapment of said rear bar within one of said plurality of cavities preventing sliding of said second D-rings along said belt, said stitching of said belt sections defining a fixed position of said second D-rings on said belt alternatively to said first D-rings, said second D-rings adapted for positioning on said belt proximal to both sides of either the smaller or larger gymnast; and (e) a releasable buckle affixed to said belt, said buckle having a frame having upper and lower portions, side frame portions, and a post slidably engaging the upper and lower frame portions between the side frame portions, said buckle adapted for securing said belt around the waist of either larger or smaller gymnast by engagement of said opposite end of said belt to said buckle.

* * * * *